US009120314B2

(12) United States Patent
Kanazawa et al.

(10) Patent No.: US 9,120,314 B2
(45) Date of Patent: Sep. 1, 2015

(54) MAINTENANCE UNIT AND LIQUID EJECTING APPARATUS

(71) Applicant: SEIKO EPSON CORPORATION, Tokyo (JP)

(72) Inventors: Yuji Kanazawa, Shirojiri (JP); Satoru Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/294,567

(22) Filed: Jun. 3, 2014

(65) Prior Publication Data

US 2014/0362139 A1 Dec. 11, 2014

(30) Foreign Application Priority Data

Jun. 5, 2013 (JP) ..... 2013-118571

(51) Int. Cl.
*B41J 2/165* (2006.01)

(52) U.S. Cl.
CPC ..... *B41J 2/16511* (2013.01)

(58) Field of Classification Search
USPC ..... 347/29
See application file for complete search history.

(56) References Cited

U.S. PATENT DOCUMENTS

| | | | | |
|---|---|---|---|---|
| 8,714,698 | B2 * | 5/2014 | Suzuki | 347/30 |
| 2012/0147090 | A1 * | 6/2012 | Sato et al. | 347/32 |

FOREIGN PATENT DOCUMENTS

| | | |
|---|---|---|
| JP | 2-106353 | 4/1990 |
| JP | 2005-169956 | 6/2005 |
| JP | 2012-121296 | 6/2012 |

* cited by examiner

*Primary Examiner* — Jason Uhlenhake
(74) *Attorney, Agent, or Firm* — Workman Nydegger

(57) ABSTRACT

A maintenance unit is a unit that maintains a liquid ejecting head and includes a cap holder that has a cap member capable of abutting against the liquid ejecting head, guide pins that guide the cap holder in a movable manner in an approaching/separating direction in which the cap member approaches and is separated from the liquid ejecting head, an engagement portion that is capable of being engaged with the cap holder, and a displacement operating portion that displaces the engagement portion between a restricting position at which the engagement portion restricts drawing of the cap holder out of the guide pins and an allowing position at which the engagement portion allows the cap holder to be drawn out of the guide pins.

13 Claims, 11 Drawing Sheets

Z
50
51
52
55
55a
56
56a
56b
57
57a
57b
60
61
62
62a
67
70
72
73
73a
74a

MAINTENANCE UNIT AND LIQUID EJECTING APPARATUS

BACKGROUND

1. Technical Field

The present invention relates to a maintenance unit that maintains a liquid ejecting head for ejecting liquid and a liquid ejecting apparatus including the maintenance unit.

2. Related Art

In general, a liquid ejecting apparatus including a liquid ejecting head for ejecting liquid onto an ejection target member to form an image and the like includes a maintenance unit for maintaining ejection performance to eject liquid from the liquid ejecting head properly (for example, see JP-A-2012-121296).

The maintenance unit includes a plurality of maintenance functions normally. That is to say, the liquid ejection performance of the liquid ejecting head is maintained by operating various functional components for maintaining the liquid ejecting head. For example, when liquid having increased viscosity or liquid in which foreign matters are mixed is present in nozzles, a suction cap is made to abut against the liquid ejecting head so as to cover the openings of the nozzles. Then, a suction pump is operated to suck the liquid having the increased viscosity from the nozzles. With this, the ejection performance is recovered such that the liquid can be ejected through the openings of the nozzles properly. Further, unnecessary liquid attached to the openings of the nozzles is wiped away with movement of a wiping member.

In the liquid ejecting apparatus, the liquid ejecting head is left in a state where the liquid is not ejected through the nozzles for a long period of time when a state where an image is not formed on the ejection target member lasts long. In the liquid ejecting head being left in such state, in order to suppress drying and increase in the viscosity of the liquid in the nozzles which are provided on the liquid ejecting head and through which the liquid is ejected, a leaving cap (cap member) for covering the nozzles so as to surround them is made to abut against the nozzle surface of the liquid ejecting head. Further, a space including the nozzles, which is covered by the abutting leaving cap, is made to communicate with the air through an air communication hole provided in the leaving cap so as to suppress evaporation of the liquid in the liquid ejecting head into the air (into the atmosphere) from the nozzles.

The suction cap and the wiping member are easy to be contaminated because they suck and wipe away a large amount of liquid. Accordingly, a configuration capable of exchanging the suction cap and the wiping member easily is employed in the maintenance unit. On the other hand, the frequency that ink attaches to the leaving cap covering the nozzles is low. Therefore, the configuration capable of exchanging the leaving cap easily is not employed in the maintenance unit in many cases. For example, in the case of detaching the leaving cap, another constituent component of the maintenance unit is required to be detached.

However, for example, if ink remains on the nozzle surface frequently, the frequency that the ink attaches to the leaving cap is increased when the leaving cap (cap member) abuts against the nozzle surface of the liquid ejecting head. When the attached ink reaches the air communication hole and is solidified, it is difficult for the leaving cap to cover the nozzles without breaking menisci formed in the nozzles, resulting in increase in the exchange frequency of the leaving cap. In this case, there arises a problem that the leaving cap (cap member) cannot be exchanged easily.

The above-mentioned circumstances are generally common to the maintenance units that have the cap member and maintain the liquid ejecting head having the nozzle surface in which the nozzles for ejecting liquid onto the ejection target member are formed.

SUMMARY

An advantage of some aspects of the invention is to provide a maintenance unit that enables a cap member to be exchanged easily and a liquid ejecting apparatus including the maintenance unit.

A maintenance unit according to an aspect of the invention is a unit which maintains a liquid ejecting head in which nozzles for ejecting liquid onto an ejection target member are formed, and includes a cap holder that has a cap member capable of abutting against the liquid ejecting head so as to surround the nozzles, a pair of guide pins that are inserted into the cap holder and guide the cap holder in a movable manner in an approaching/separating direction in which the cap member approaches and is separated from the liquid ejecting head, an engagement portion that is capable of being engaged with the cap holder in the approaching/separating direction, and a displacement operating portion that displaces the engagement portion between a restricting position at which the engagement portion restricts drawing of the cap holder out of the guide pins and an allowing position at which the engagement portion is not engaged with the cap holder in the approaching/separating direction and allows the cap holder to be drawn out of the guide pins.

With this configuration, the displacement operating portion displaces the engagement portion so as to draw the cap holder out of the maintenance unit. Accordingly, the cap holder (cap member) can be exchanged easily without detaching members from the maintenance unit.

In the maintenance unit according to the above-mentioned aspect of the invention, it is preferable that the maintenance unit include a head maintenance portion that maintains the liquid ejecting head by discharging the liquid from the nozzles, and the displacement operating portion be provided at a position separated from the head maintenance portion relative to the engagement portion.

With this configuration, the displacement operating portion is provided at the position separated from the head maintenance portion. Therefore, a possibility that the liquid discharged from the liquid ejecting head attaches to the displacement operating portion lowers. This suppresses a problem that a user's hand becomes dirty when the user operates the displacement operating portion.

In the maintenance unit according to the above-mentioned aspect of the invention, it is preferable that the cap holder be provided with guide holes into which the guide pins are inserted, and the guide holes be through-holes penetrating the cap holder.

With this configuration, the guide pins can be inserted into the guide holes of the cap holder easily while checking the positions of the guide pins through the through-holes. Accordingly, an exchange operation of the cap holder is performed easily.

In the maintenance unit according to the above-mentioned aspect of the invention, it is preferable that the engagement portion be provided at a position at which at least a part of the engagement portion overlaps with the pair of guide pins to be inserted into the cap holder in a direction in which the guide pins are aligned.

With this configuration, when the user tries to draw the cap holder out of the guide pins in a state where the engagement portion is located at the restricting position, the pair of guide pins and the engagement portion are aligned substantially in line. Therefore, a force of inclining the cap holder with respect to the guide pins is difficult to be applied. This suppresses deformation of the cap holder, for example.

A liquid ejecting apparatus according to another aspect of the invention includes a liquid ejecting head that ejects liquid onto an ejection target member and the maintenance unit having the above-mentioned configuration.

With this configuration, the liquid ejecting apparatus that enables the cap holder (cap member) to be exchanged easily is provided.

In the liquid ejecting apparatus according to the above-mentioned aspect of the invention, it is preferable that the liquid ejecting apparatus further include a discharge portion that discharges the ejection target member onto which the liquid has been ejected, and the displacement operating portion be located at a downstream side in a discharge direction in which the ejection target member is discharged in the maintenance unit.

With this configuration, the displacement operating portion can be operated from the side in the discharge direction in which the ejection target member onto which the liquid ejecting head has ejected the liquid is discharged. Accordingly, the displacement operating portion is operated from the front side of the liquid ejecting apparatus, which normally corresponds to the discharge direction of the ejection target member, thereby making it possible to perform an exchange operation easily when the cap holder (cap member) is exchanged.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, an embodiment of a liquid ejecting apparatus will be described with reference to the drawings.

Figure 1:
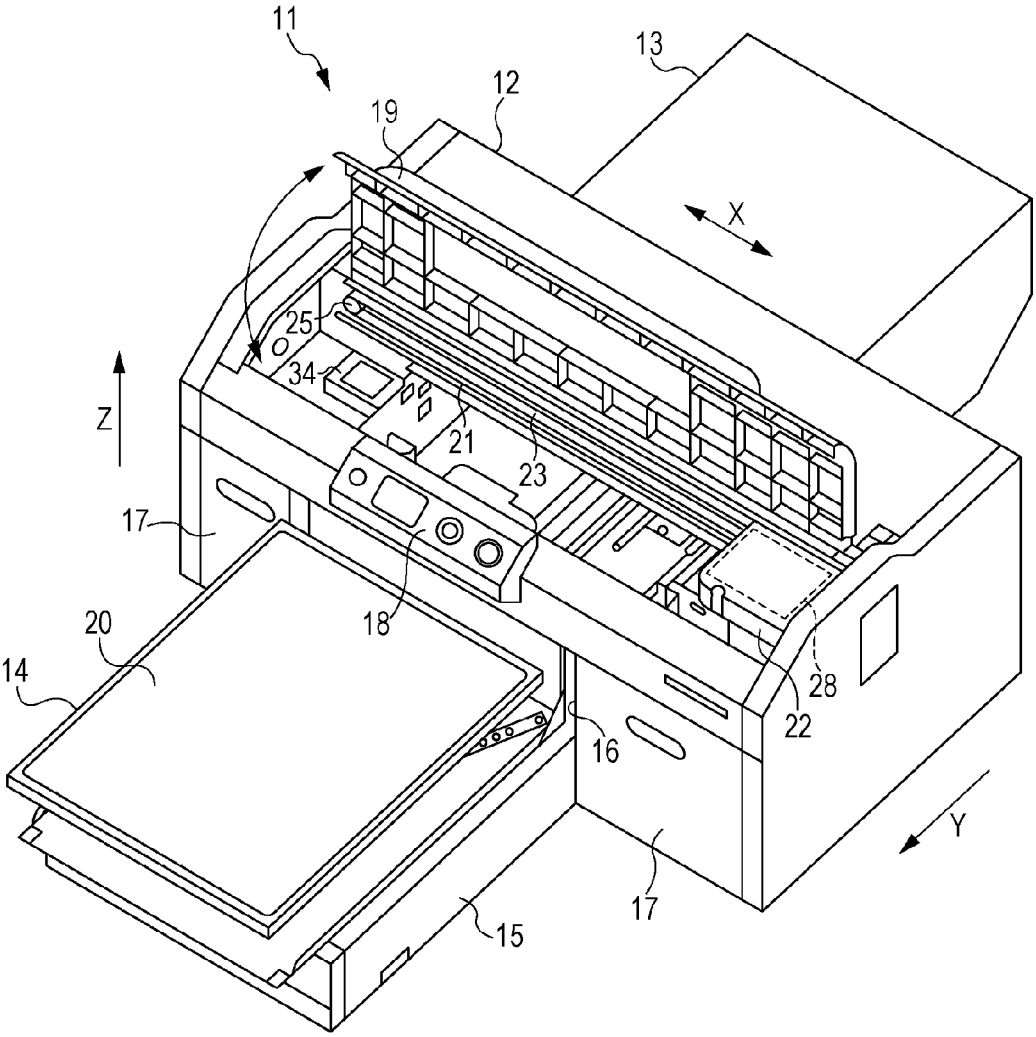
FIG. 1 is a perspective view illustrating the schematic configuration of a printer according to an embodiment.

As illustrated in FIG. 1, a printer 11 serving as an example of a liquid ejecting apparatus in the embodiment includes a first housing portion 12 and a second housing portion 13. The first housing portion 12 has a substantially rectangular box shape elongated in a lengthwise direction. The second housing portion 13 is provided in parallel with the first housing portion 12, on a side in one direction intersecting with the lengthwise direction of the first housing portion 12. In the embodiment, in the printer 11, the side at which the first housing portion 12 is provided with respect to the second housing portion 13 is referred to as a front side and the side at which the second housing portion 13 is provided with respect to the first housing portion 12 is referred to as a rear side. For ease in explanation, the direction extending toward the first housing portion from the second housing portion 13, which intersects with (in the embodiment, is orthogonal to) the vertical direction, is referred to as a Y direction in the respective drawings to be referred to. Further, the direction along the lengthwise direction of the first housing portion 12 is referred to as an X direction and the antigravity direction in the vertical direction is referred to as a Z direction.

A medium transportation portion 15 is fixed to the first housing portion 12 in a state of projecting to the front side from the first housing portion 12. The medium transportation portion 15 supports a medium supporting tray 14 so as to transport it along the Y direction. An opening 16 is formed in the front surface of the first housing portion 12. The opening 16 allows front-rear movement of the medium supporting tray 14 along the Y direction. A space (not illustrated) for allowing the movement of the medium supporting tray 14 is formed in the first housing portion 12 and the second housing portion 13 across the first housing portion 12 and the second housing portion 13. In the following description, the space formed across the first housing portion 12 and the second housing portion 13 and the opening formed in the front surface of the first housing portion 12 are collectively referred to as the opening 16.

Open/close covers 17 are attached to the front surface of the first housing portion 12 at both sides of the opening 16 in the X direction in a rotationally movable manner. The open/close covers 17 are moved rotationally about rotational shafts (not illustrated) provided at the side of the lower ends thereof such that the upper ends thereof are moved in a swing manner. With the rotational movement, the open/close covers 17 are arranged at close positions as illustrated in FIG. 1 and open positions. The upper end portions of the open/close covers 17 are moved to the front lower side in the swing manner, so that the open/close covers 17 are arranged at the open positions to expose the inner portions.

Further, an input panel 18 for inputting commands relating to the operations of the printer 11 is attached to the upper side of the opening 16. An upper cover 19 is provided at the rear side of the input panel 18 in a rotationally movable manner. The upper cover 19 is moved rotationally about a rotational shaft (not illustrated) provided at the side of the base end of the housing portion. With the rotational movement, the upper cover 19 is arranged at an open position as illustrated in FIG. 1 and a close position. The front end of the upper cover 19 is moved to the front lower side from the open position in the swing manner, so that the upper cover 19 is arranged at the close position to cover accommodated members in the housing portion 12.

A guide shaft 21 extending along the lengthwise direction (X direction) of the first housing portion 12 is provided in the first housing portion 12. A carriage 22 is supported on the guide shaft 21 so as to reciprocate along the X direction. Further, a pair of pulleys 25 (in FIG. 1, only one of them is illustrated) are supported in the first housing portion 12 in a rotatable manner. A timing belt 23 a part of which is fixed to the carriage 22 is wound around the pair of pulleys 25.

A liquid ejecting head 28 is mounted on the lower surface of the carriage 22, which is a surface at the gravity direction side. The liquid ejecting head 28 has a nozzle surface in which a plurality of nozzles capable of ejecting ink are formed. If one of the pulleys 25 rotates by driving of a motor and the timing belt 23 revolves around the pulleys 25, the liquid ejecting head 28 reciprocates along the X direction together with the carriage 22.

Figure 2:
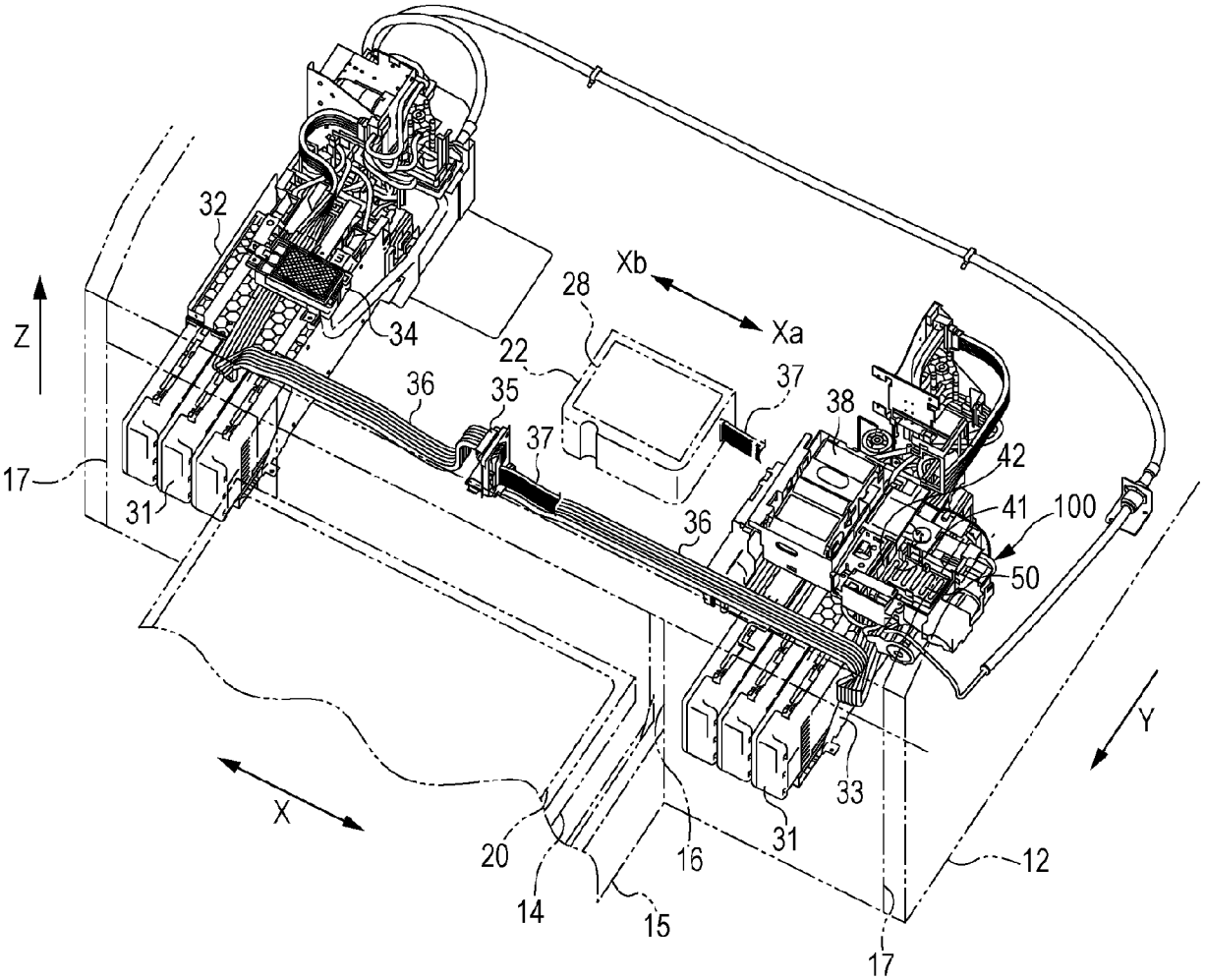
FIG. 2 is a perspective view illustrating the configuration of an inner portion of a housing in a state where a carriage is moved from a maintenance unit in the printer in a see-through manner.

As illustrated in FIG. 2, cartridge holders 32 and 33 are provided in the first housing portion 12 at both sides of the opening 16 in the lengthwise direction (X direction). Ink cartridges 31 accommodating ink serving as an example of liquid are attached to the cartridge holders 32 and 33 in a detachable manner. Therefore, when the open/close covers 17 are arranged at the open positions, the cartridge holders 32 and 33 or the ink cartridges 31 attached to the cartridge holders 32 and 33 are exposed. It should be noted that at least one (in the embodiment, three) ink cartridge 31 can be attached to each of the cartridge holders 32 and 33.

The printer 11 includes an ink supply portion. The ink supply portion supplies the ink accommodated in the ink cartridges 31 attached to the cartridge holders 32 and 33 to the liquid ejecting head 28 side. To be specific, the ink supply portion is configured by a junction path portion 35, bifurcating tubes 36, and junction tubes 37. The junction path portion 35 is located above the opening 16. The bifurcating tubes 36 and the junction tubes 37 are connected through the junction path portion 35.

One end of each of the bifurcating tubes 36 is connected to any one of the cartridge holders 32 and 33 and the other end thereof is connected to the junction path portion 35. Further, the plurality of junction tubes 37 are provided in a band form and one end of each junction tube 37 is connected to the junction path portion 35 and the other end thereof is connected to the liquid ejecting head 28. Accordingly, ink accommodated in the ink cartridges 31 attached to the holders 32 and 33 is supplied to the liquid ejecting head 28 as an ink consumption portion through the bifurcating tubes 36, the junction path portion 35, and the junction tubes 37.

The medium supporting tray 14 reciprocates to the front and rear sides along the Y direction between a medium set position and a print start position by driving of a transportation motor (not illustrated). The medium set position is a position at which the medium supporting tray 14 is exposed from the first housing portion 12 to the front side thereof and an ejection target member 20 can be set on the medium supporting tray 14. Further, the medium set position is also a position at which the ejection target member 20 onto which ink has been ejected is discharged. Accordingly, in this case, the medium transportation portion 15 functions as a discharge portion.

A flushing box 34 serving as an example of a liquid receiver capable of receiving the ink ejected from the liquid ejecting head 28 is provided in the first housing portion 12. To be specific, the flushing box 34 is provided in a movement region in which the liquid ejecting head 28 can be moved. A maintenance unit 100 is provided in the movement region of the liquid ejecting head 28 at a position (home position) at the side opposite to the side at which the flushing box 34 is provided with the opening 16 interposed therebetween. The maintenance unit 100 performs maintenance processing on the liquid ejecting head 28 to maintain ink ejection performance through the nozzles.

That is to say, the maintenance unit 100 includes a leaving cap 50 and a suction cap 41. The leaving cap 50 is used for suppressing evaporation of the ink in the respective nozzles of the liquid ejecting head 28 when printing is stopped or the printer 11 is not used, and so on. The suction cap 41 sucks the ink from the nozzles to perform cleaning. Further, the maintenance unit 100 includes a wiper 42. The wiper 42 abuts against the nozzle surface while being deformed elastically so as to wipe the nozzle surface. In the embodiment, an absorbing member 38 is provided so as to be adjacent to the maintenance unit 100 at the side at which the flushing box 34 is provided. The absorbing member 38 abuts against the nozzle surface so as to absorb the ink attached to the nozzle surface. It should be noted that the absorbing member 38 may be provided as a part of the maintenance unit 100.

In the embodiment, the suction cap 41 and the wiper 42 are provided in the maintenance unit 100 in a detachable manner so as to be exchanged. As will be described later, the leaving cap 50 is also provided so as to be exchanged. Therefore, the leaving cap 50, the suction cap 41, and the wiper 42 in the maintenance unit 100 are arranged such that a user can access them through an opening formed by displacing the upper cover 19 to the open position as illustrated in FIG. 1. This enables the user to exchange the leaving cap 50, the suction cap 41, and the wiper 42 from the front side of the printer 11 easily. In the embodiment, the absorbing member 38 and the flushing box 34 can be also exchanged easily from the front side through the opening in the same manner.

Further, the maintenance unit 100 includes movement mechanisms that individually make the leaving cap 50 and the suction cap 41 reciprocate between abutment positions at which they can abut against the liquid ejecting head 28 and separate positions at which they are separated from the liquid ejecting head 28. In addition, the maintenance unit 100 also includes a movement mechanism that moves the wiper 42 in the front-rear direction with respect to the nozzle surface of the liquid ejecting head 28. These movement mechanisms are controlled by a controller (not illustrated) that controls operations of the printer 11, and operate in accordance with commands input to the input panel 18, for example.

That is to say, the controller controls the maintenance unit 100 to perform a cleaning processing operation on the liquid ejecting head 28. The cleaning processing operation is an operation for removing the ink attached to the nozzle surface of the liquid ejecting head 28 by wiping with the wiper 42 and sucking and discharging the ink having the increased viscosity, which remains in the nozzles, with the suction cap 41. Accordingly, each of the wiper 42 and the suction cap 41 functions as a head maintenance portion.

Moreover, in the printer 11, the controller controls to remove the ink attached to the nozzle surface of the liquid ejecting head 28 by contact with the absorbing member 38 and eject the ink having the increased viscosity into the flushing box 34 to discharge the ink from the nozzles. Further, the printer 11 performs printing on the ejection target member 20 that is transported in the front-rear direction along the Y direction with the transportation of the medium supporting tray 14 in the following manner. That is, the carriage 22 (liquid ejecting head 28) is moved in the X direction and the ink is ejected through the nozzles at a timing based on image data to be printed so as to make the ink land on the ejection target member 20. Then, the medium supporting tray 14 is returned to the medium set position, so that the ejection target member 20 on which printing has been performed is moved to the front side (Y direction side) of the printer 11 as the discharge direction side of the target member. For convenience of explanation, the X direction as the movement direction of the carriage 22 is distinguished so that the rightward direction is referred to as an Xa direction and the leftward direction is referred to as an Xb direction when seen from the Y direction side as the discharge direction side of the ejection target member 20.

Next, the configuration of the maintenance unit 100 will be described in detail with reference to FIG. 3 and FIG. 4.

Figure 3:
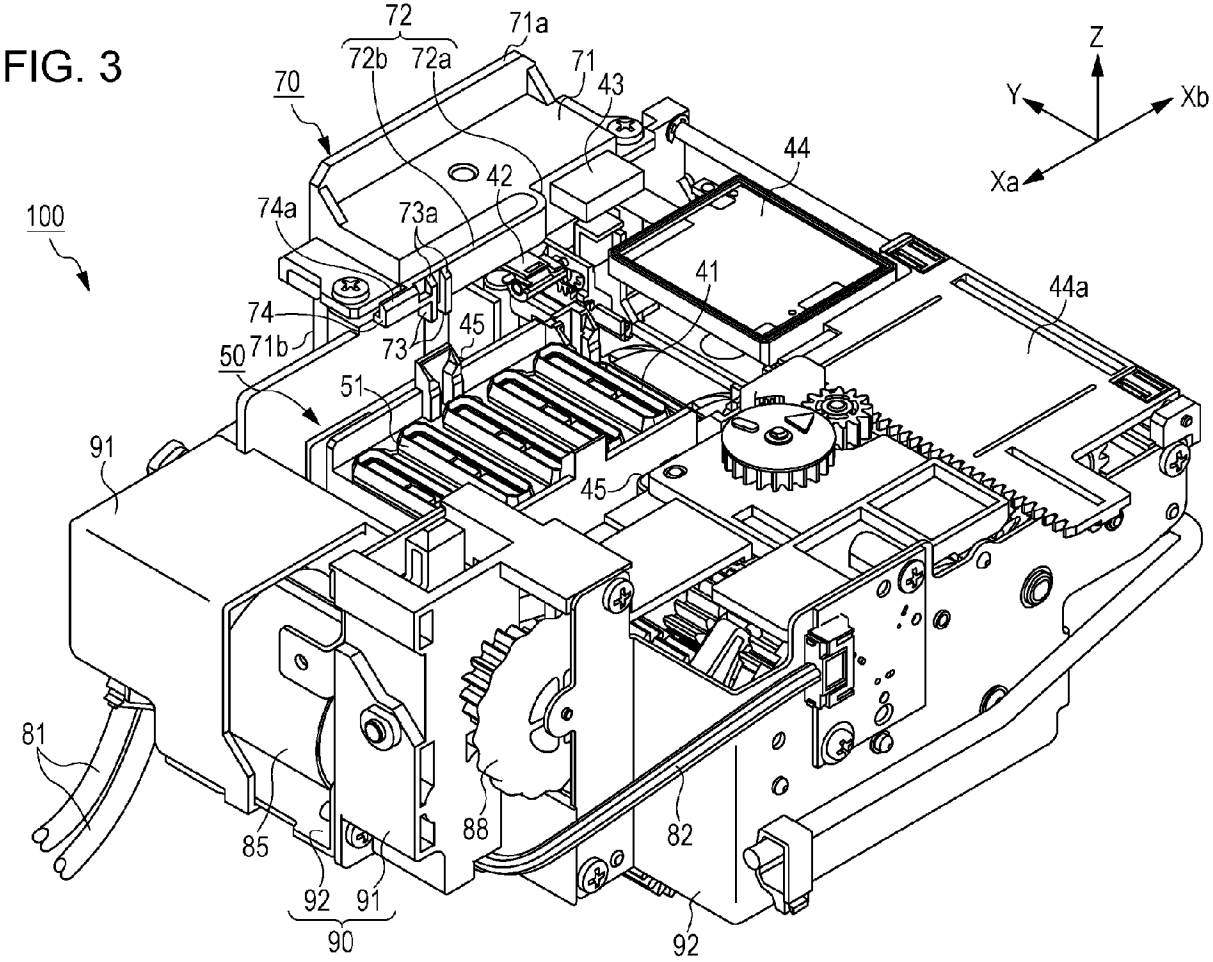
FIG. 3 is a perspective view illustrating the schematic configuration of the maintenance unit.
Figure 4:
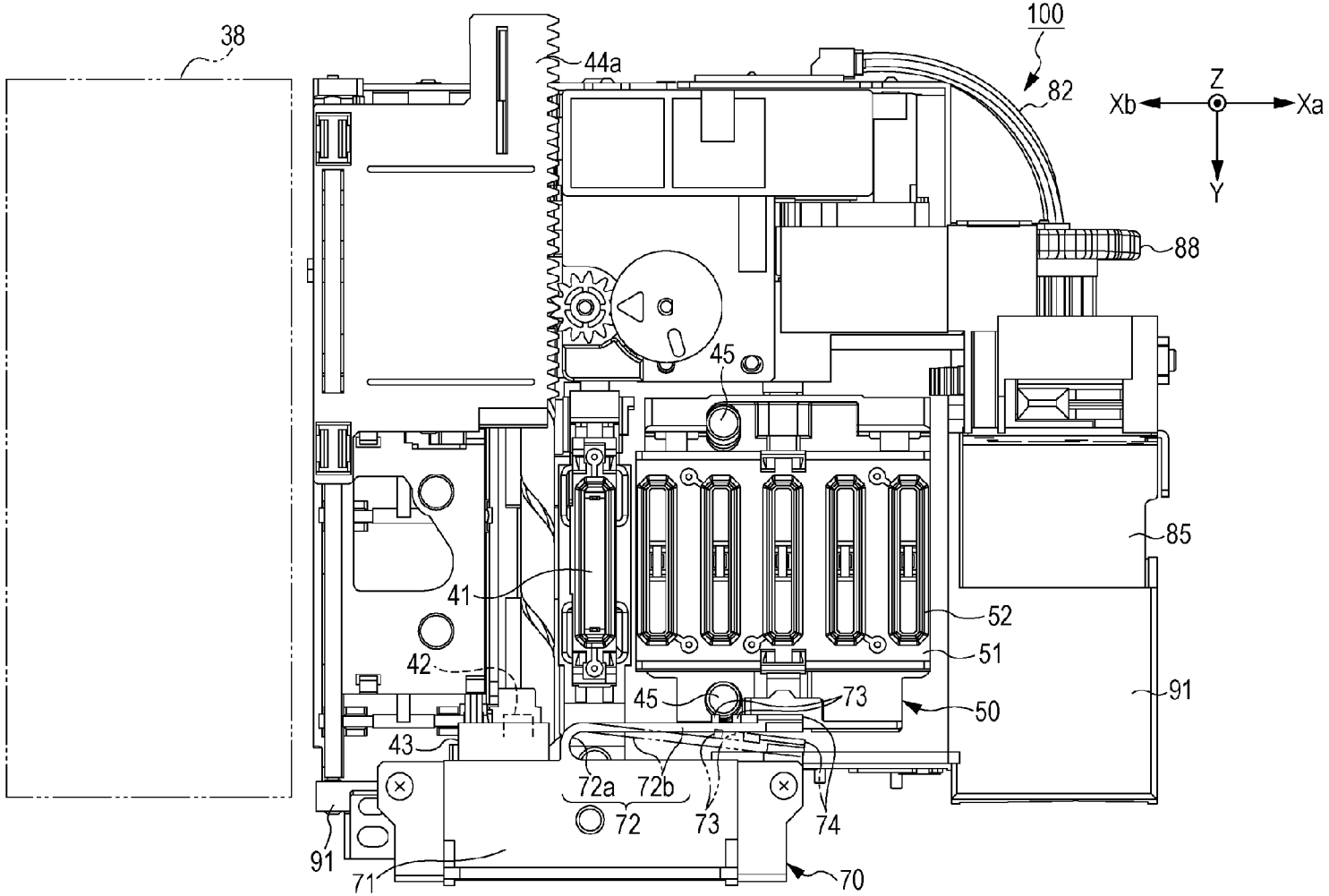
FIG. 4 is a plan view illustrating the maintenance unit when seen from the above in the vertical direction.

As illustrated in FIG. 3 and FIG. 4, the maintenance unit 100 includes the leaving cap 50. The leaving cap 50 forms a closed space by abutting against the liquid ejecting head 28 which is left in a state where it does not eject ink onto the ejection target member 20 so as to surround the nozzles. That is to say, the leaving cap 50 forms the closed space between the leaving cap 50 and the nozzle surface of the liquid ejecting head 28 in which the nozzles are formed when the printer 11 is powered OFF and so on, thereby suppressing drying of the ink in the openings of the nozzles. Further, the leaving cap 50 is moved in the up-down direction by being guided by guide pins 45 so as to approach or be separated from the liquid ejecting head 28, so that the liquid ejecting head 28 is capped with a cap member 51. The guide pins 45 are fixed to a frame structure 90. In the embodiment, the cap member 51 covers five nozzle rows (row groups) provided on the liquid ejecting head 28 so as to shield the nozzle openings in the respective nozzle rows (row groups) from the air.

The maintenance unit 100 includes the suction cap 41 and a suction pump (not illustrated) for sucking, for example, the ink having the increased viscosity from the nozzle openings so as to recover the ink ejection performance. The suction cap 41 is moved in the up-down direction so as to approach or be separated from the liquid ejecting head 28, thereby capping the liquid ejecting head 28. The suction cap 41 forms a closed space by abutting against one nozzle row (row group) among the five nozzle rows (row groups) provided on the liquid ejecting head 28 so as to surround it. The closed space is formed for shielding the nozzle openings of the nozzle row (row group) from the air. In the state where the closed space is formed in this manner, the suction pump decompresses the closed space covered by the suction cap 41 so as to suck the ink from the nozzle openings and discharges the sucked ink to a waste ink tank (not illustrated) through discharge tubes 81. The waste ink tank is provided in the first housing portion 12 of the printer 11, for example.

Further, in addition to discharging ink to the flushing box 34, the maintenance unit 100 makes it possible to execute an operation of ejecting ink forcibly, that is, a flushing operation in order to discharge air bubbles mixed in the ink and the ink having the increased viscosity from the nozzles. That is to say, as illustrated in FIG. 3, the maintenance unit 100 can be provided with an ink receiver 44 as a functional component for receiving the ink ejected by the flushing operation. Accordingly, the maintenance unit 100 includes a receiver cover 44*a* that covers the ink receiving surface of the ink receiver 44 to prevent drying of the ink in the ink receiver 44. The receiver cover 44*a* can be moved in the front-rear direction for closing and opening an upper portion of the ink receiver 44 at the time of the printer 11 being not used such as when the printer 11 does not eject the ink onto the ejection target member 20 to form an image, and so on. Needless to say, the ink receiver 44 is configured so as to be detachable from the maintenance unit 100, and FIG. 2 and FIG. 4 illustrate a state where the ink receiver 44 has been detached from the maintenance unit 100.

The maintenance unit 100 includes the wiper 42 that wipes away unnecessary ink attached to the nozzle surface of the liquid ejecting head 28. The wiper 42 is configured to reciprocate in the front-rear direction. The wiper 42 is moved from the rear side to the front side along the alignment direction of the nozzle row with respect to the liquid ejecting head 28 so as to catch and wipe away the unnecessary ink from the nozzle surface.

The maintenance unit 100 further includes an ink absorber 43 that is arranged at an end portion in the movement direction of the wiper 42 moving to the front side. The ink absorber 43 can absorb the ink caught by the wiper 42. That is to say, the wiper 42 is made to abut against at least a part of the ink absorber 43, so that the ink caught by the wiper 42 is passed to and absorbed by the ink absorber 43.

In the embodiment, the ink absorber 43 is attached to a unit frame body 70 arranged in the maintenance unit 100 at the front (Y direction) end portion. In the embodiment, there arises no problem even if the maintenance unit 100 is not necessarily provided with the wiper 42. In this case, the ink absorber 43 is not required to be provided on the unit frame body 70.

The unit frame body 70 includes a frame body portion 71 having a substantially rectangular shape. The lengthwise direction of the frame body portion 71 is set along the X direction when seen from the above. An upper wall portion 71*a* projecting upward and a lower wall portion 71*b* projecting downward are provided at the front end of the frame body portion 71 at the Y direction side. On the other hand, an extending portion 72 is provided at the rear end of the frame body portion 71. The extending portion 72 is configured such that members thereof extend so as to protrude to the rear side in a predetermined shape.

The extending portion 72 is a plate-formed section having a substantially uniform predetermined width in the vertical direction (Z direction) and includes a bent plate section 72*a* and a flat plate section 72*b*. The bent plate section 72*a* extends from the frame body portion 71 and has a substantially circular semi-cylindrical shape when seen from the above. The flat plate section 72*b* extends from the bent plate section 72*a* following the Xa direction in the lengthwise direction (X direction) substantially linearly when seen from the above. The flat plate section 72*b* has a predetermined length. That is to say, the extending portion 72 has a substantially J shape formed by the bent plate section 72*a* and the flat plate section 72*b* when seen from the lower side (Z direction side). Further, the extending portion 72 is formed on the frame body portion 71 in a cantilever state while the flat plate section 72*b* is a free end. The extending portion 72 is formed so as to extend in the direction intersecting with the vertical direction.

Two projection ribs 73 of which lengthwise direction extends along the vertical direction are formed on halfway of the flat plate section 72*b* so as to project from both the rear surface and the lower surface of the flat plate section 72*b*. A step part 74 is formed at a tip end portion of the flat plate section 72*b*. The step part 74 has a step surface whose plate surface (rear surface) is shifted to the rear side. Inclined surfaces 73*a* and an inclined surface 74*a* sloped downward to the rear side are formed on the upper ends of the two projection ribs 73 and the step part 74, respectively. In the embodiment, at least the extending portion 72 is made of a material (for example, resin material) that can be deformed elastically.

The maintenance unit 100 includes the frame structure 90 which is constituted by a plurality of frame members 91 made of a resin and a plurality of frame plates 92 made of a metal, and in which constituent components such as the above-mentioned leaving cap 50 are arranged. The unit frame body 70 is fixed to the frame structure 90 (frame member 91) by screwing both end portions thereof in the lengthwise direction. When the unit frame body 70 is fixed, a user holds the upper wall portion 71*a* of the frame body portion 71, causes the lower wall portion 71*b* to be in contact with the frame member 91, and so on, in order to perform a fixing operation of the unit frame body 70 easily.

In a state where the unit frame body 70 has been fixed in this manner, as illustrated in FIG. 4, the extending portion 72 of the unit frame body 70 is in a state where at least parts of the two projection ribs 73 formed on the flat plate section 72*b* overlap with the leaving cap 50 in the approaching/separating direction (in this example, vertical direction), that is, an engaged state. Accordingly, the two projection ribs 73 function as an engagement portion.

As illustrated in FIG. 4, the two projection ribs 73, as the engagement portion, of the extending portion 72 are provided at positions at which at least parts thereof overlap with the pair of guide pins 45 in the alignment direction (Y direction) of the guide pins 45. Therefore, in order to detach the leaving cap 50 from the maintenance unit 100, as indicated by a two-dot chain line in FIG. 4, the flat plate section 72*b* is displaced by moving the step part 74 to the front side (Y direction side) so as to make a state where the two projection ribs 73 are not engaged with the leaving cap 50 when seen from the approaching/separating direction. That is to say, the step part 74 functions as a displacement operating portion. When the user displaces the step part 74, the two projection ribs 73 as the engagement portion are displaced so as to be disengaged from the leaving cap 50 when seen from the approaching/separating direction. In the disengaged state, the leaving cap 50 is in a state capable of being drawn to the upper side along the approaching/separating direction out of the maintenance unit 100.

In other words, the extending portion 72 includes the projection ribs 73 and the step part 74 so as to function as a drawing restricting member that restricts the drawing of the leaving cap 50. In the embodiment, on the extending portion 72, the step part 74 is provided at a position separated from the wiper 42 and the suction cap 41 functioning as the head maintenance portions relative to the projection ribs 73 as the engagement portion.

As illustrated in FIG. 3, the maintenance unit 100 in the embodiment is configured such that the plurality of constituent components as described above in the maintenance unit 100 operate by rotation driving of a motor 85 as a driving source. The motor 85 rotates in accordance with an electric signal supplied through input wiring 82. Then, a cam mechanism 60 (see FIG. 6) operates by the rotation driving of the motor 85 controlled by the controller. With this, the leaving cap 50 is moved upward by being guided by the pair of guide pins 45 along the approaching/separating direction so as to be detached from the maintenance unit 100. A hand-turned wheel 88 for operating the constituent components, which is used when the motor 85 is not driven rotationally, is provided.

Figure 5:
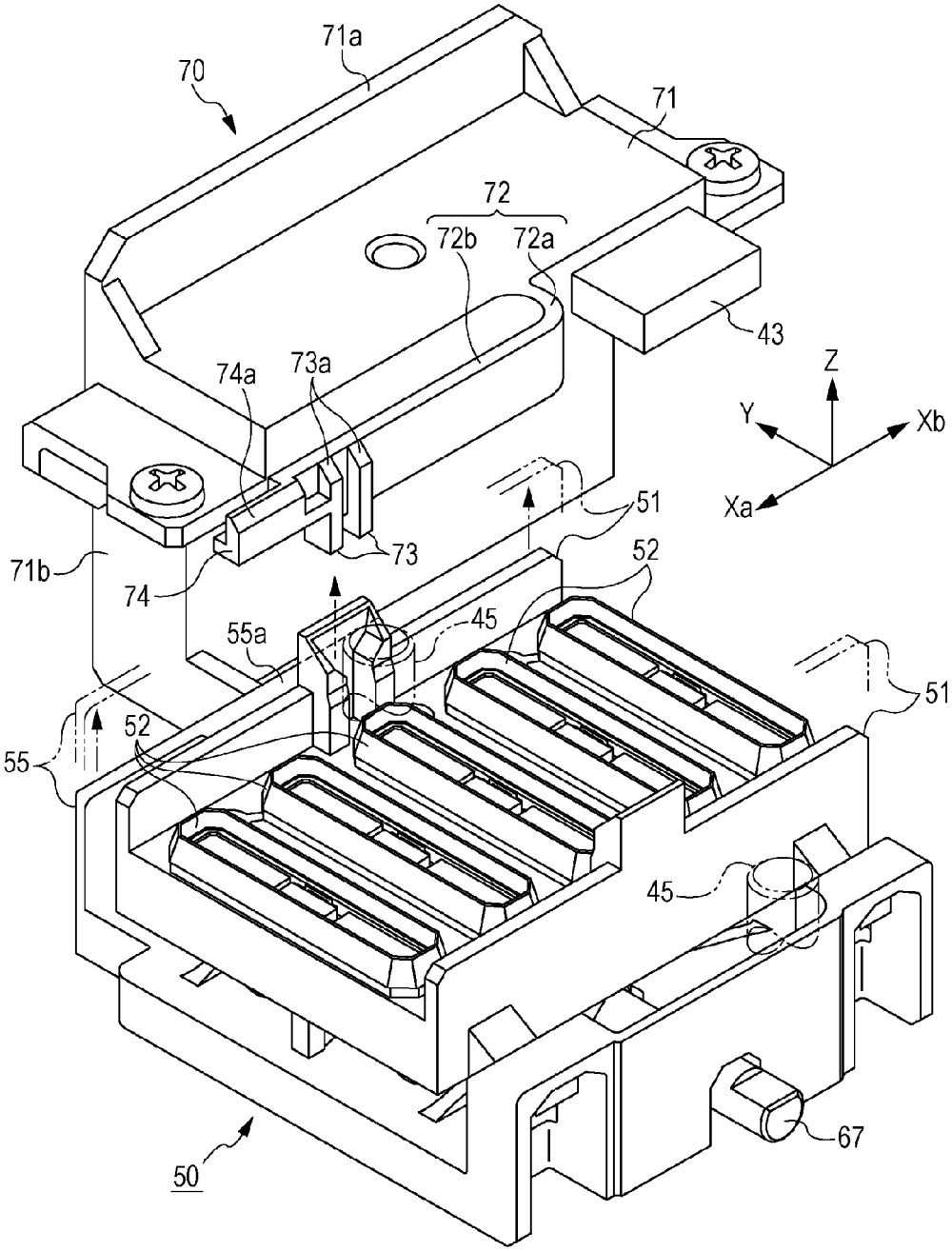
FIG. 5 is a perspective view illustrating positional relation between a leaving cap and an engagement portion.

Next, the configuration of the leaving cap 50 will be described with reference to FIG. 5 to FIG. 7. In FIG. 5, the unit frame body 70 is illustrated for showing positional relation with the leaving cap 50 in the maintenance unit 100 for the convenience of explanation.

Figure 6:
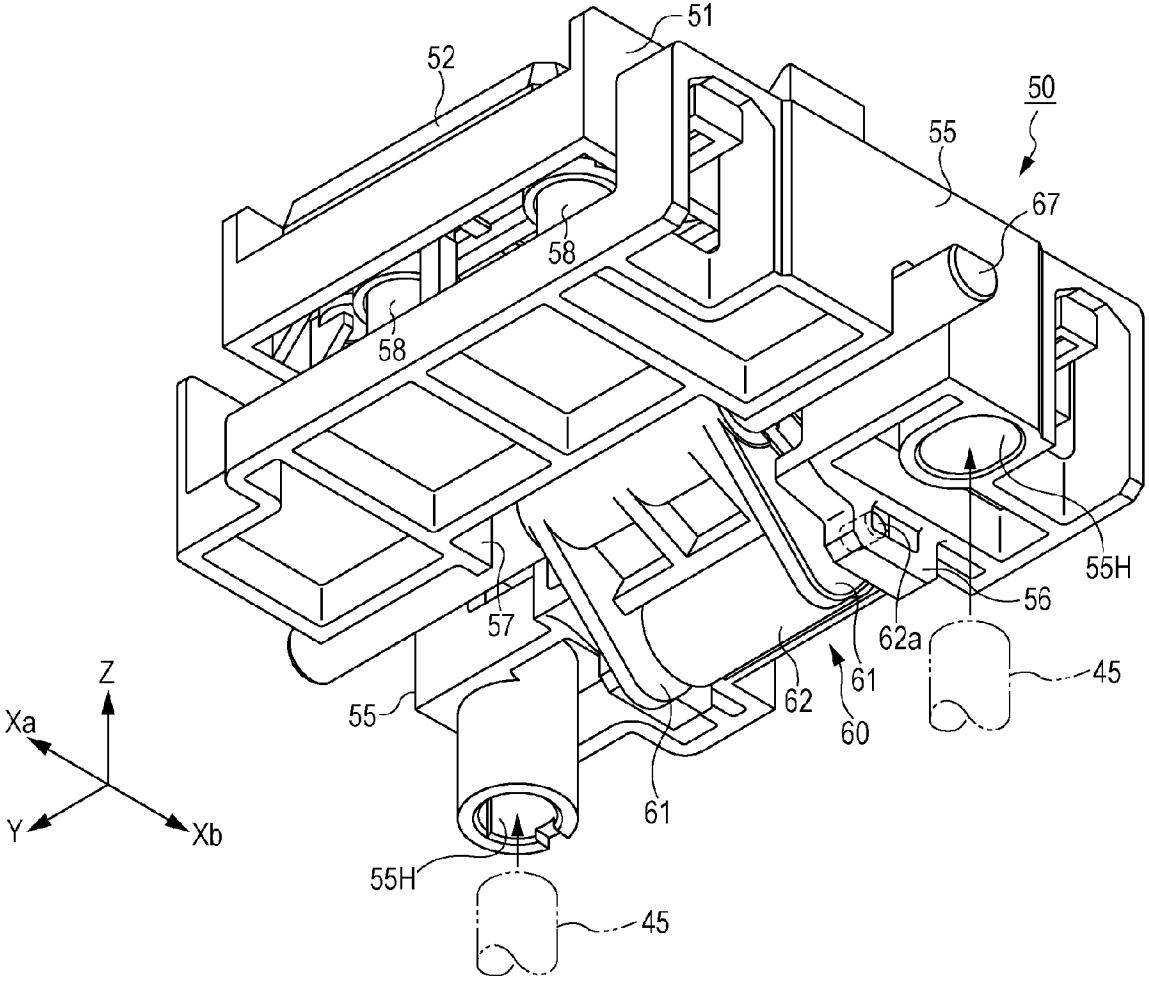
FIG. 6 is a perspective view illustrating the leaving cap when seen from the obliquely lower side.

As illustrated in FIG. 5 and FIG. 6, the leaving cap 50 includes the cap member 51 and a cap holder 55. The cap member 51 is provided with five abutment portions 52 abutting against the nozzle rows (nozzle groups) of the liquid ejecting head 28. The cap holder 55 includes the cap member 51 in a state of holding the cap member 51 through a biasing member. The cap holder 55 includes two guide holes 55H with the cap member 51 interposed therebetween in the front-rear direction (Y direction). The guide pins 45 are inserted into the respective guide holes 55H. In the embodiment, the guide pins 45 (guide holes 55H) are aligned in parallel so as to overlap with each other in the Y direction. The cap holder 55 is moved in the up-down direction by the cam mechanism 60 while the guide holes 55H are guided by the pair of guide pins 45. In the embodiment, the two guide holes 55H are formed as through-holes penetrating the cap holder 55 in the approaching/separating direction (vertical direction) thereof.

The cam mechanism 60 includes a cam frame 61 having an elongated substantially triangular shape when seen from the side. A base end portion of the cam frame 61 is fixed to an intermediate portion of a rotating shaft 67 that rotates by the rotation driving of the motor 85. Further, a shaft portion 62*a* of a cam roller 62 is axially supported on a tip end portion of the cam frame 61 in a rotationally movable manner. The shaft portion 62*a* of the cam roller 62 is configured so as to penetrate the cam frame 61 in the front-rear direction and project from both the front and rear side surfaces of the cam frame 61 in the front-rear direction. Accordingly, when the cam frame 61 rotates about the rotating shaft 67 with the rotation of the rotating shaft 67, the cam roller 62 that is axially supported on the tip end portion of the cam frame 61 revolves about the rotating shaft 67. In the embodiment, the cam frame 61 and the cam roller 62 having the shaft portion 62*a* supported on the cam frame 61 in the cam mechanism 60 function as an elevating member that moves up and down the leaving cap 50 (cap holder 55) with the rotation.

Further, a recess 57 is formed in the cap holder 55 of the leaving cap 50 at a substantially center portion of the bottom surface thereof so as to open to the lower side. The cam mechanism 60 for the leaving cap 50 is inserted into the recess 57 from the lower side. Accordingly, the guide holes 55H are provided in the cap holder 55 at positions that do not overlap with the cam mechanism 60 and the rotating shaft 67. The guide pins 45 are inserted into the guide holes 55H in a loosely fitted state, so that the cap holder 55 is guided while suppressing inclination thereof in the up-down direction. As indicated by a dashed line arrow in FIG. 5, the cap holder 55 can be smoothly moved in a sliding manner (moved up and down) until a front upper surface portion 55*a* of the cap holder 55 abuts against the projection ribs 73 of the unit frame body 70.

Further, the cap member 51 of the leaving cap 50 is attached to an upper portion of the cap holder 55 through coil springs 58 as the biasing member. The coil springs 58 allow the cap member 51 to be moved downward so as to be closer to the cap holder 55 relatively after abutting against the nozzle surface of the liquid ejecting head 28. Thus, the leaving cap 50 is configured such that the cap holder 55 and the cap member 51 biased by the coil springs 58 can be moved up and down integrally as indicated by two-dot chain lines in FIG. 5.

Figure 7:
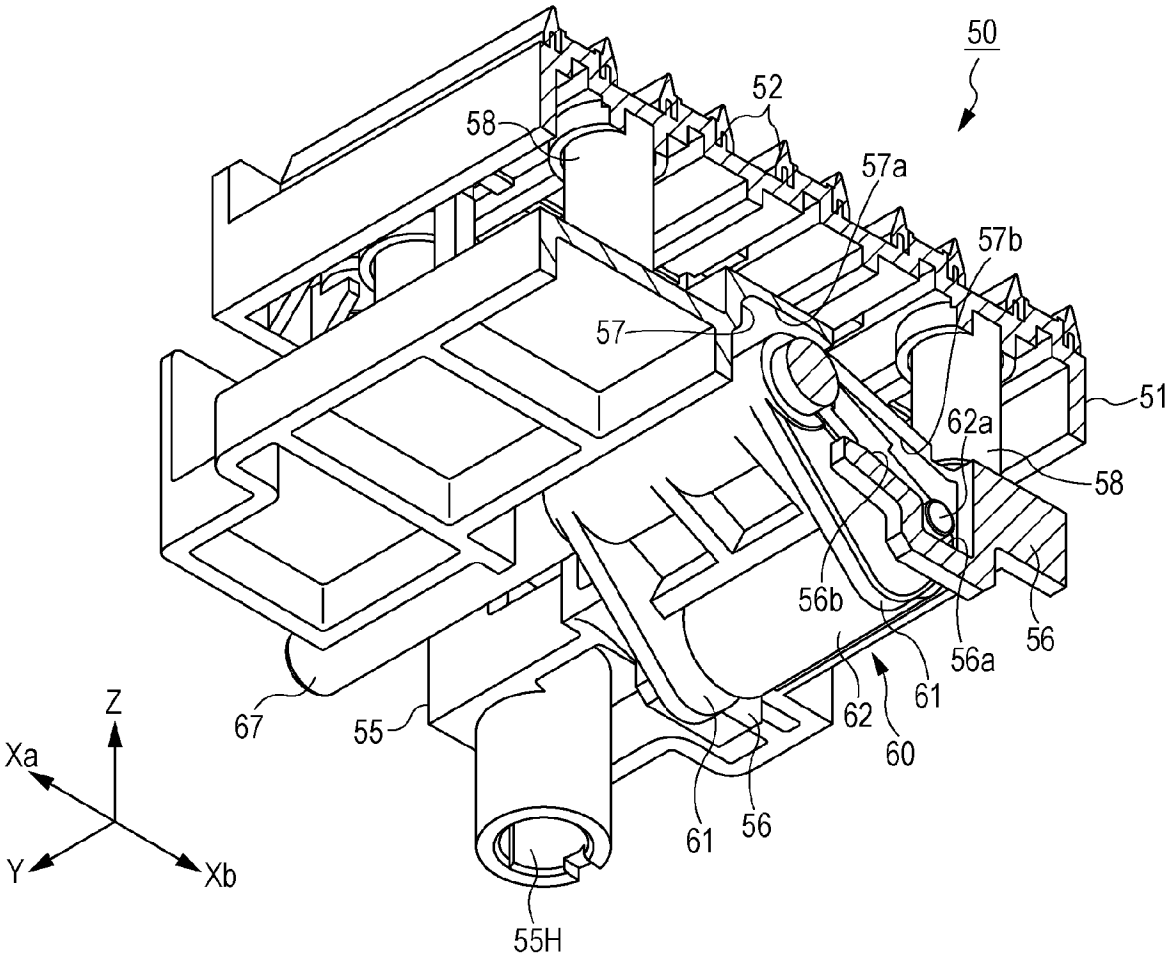
FIG. 7 is a perspective view illustrating the leaving cap and a cam mechanism that moves up and down the leaving cap in a cut state when seen from the obliquely lower side.

To be more specific, as illustrated in FIG. 7, a flat surface part 57*a* and an inclined surface part 57*b* are formed on the bottom surface of the recess 57 of the cap holder 55. The flat surface part 57*a* is located at the right side (Xa direction side). The inclined surface part 57*b* forms a slope descending to the left side (Xb direction side) from the flat surface part 57*a*. A pair of wall portions 56 are provided on a portion of the bottom surface of the cap holder 55 at the left side (Xb direction side) so as to be along the vertical direction. These wall portions 56 include recessed surface portions 56*a* and inclined surface portions 56*b*. The recessed surface portions 56*a* have a shape recessed downward in the vicinity of the left inner side surface of the recess 57. The inclined surface portions 56*b* each extend to the diagonally upper right side from the recessed surface portions 56*a* in a slanted manner. The tip ends (right ends in FIG. 7) of the inclined surface portions 56*b* of the wall portions 56 are located at the left side relative to the flat surface part 57*a* located at the right side in the recess 57.

Further, these wall portions 56 are arranged so as to be separated from each other in the front-rear direction by a distance that is substantially the same as the dimension of the cam frame 61 in the front-rear direction.

The shaft portion 62*a* of the cam roller 62 is arranged in the recessed surface portions 56*a* of the wall portions 56 in a state where the cap holder 55 is attached to the cam mechanism 60, as illustrated in FIG. 7. Therefore, even when the cap holder 55 is tried to be lifted or moved to the right and left sides in this state, the detachment operation of the cap holder 55 from the cam mechanism 60 is restricted because the shaft portion 62*a* of the cam roller 62 locks the recessed surface portions 56*a* of the wall portions 56 in the upper direction and the right-left direction. In other words, the leaving cap 50 cannot be detached from the maintenance unit 100 in this state.

On the other hand, in the cap holder 55, the flat surface part 57*a* as a part of the bottom surface of the recess 57 facing downward is a non-overlapping region. To be specific, the flat surface part 57*a* as the non-overlapping region does not overlap with the surface formed by the recessed surface portion 56*a* and the inclined surface portion 56*b* of the wall portion 56 facing upward and opposing the recess 57 in the right-left direction orthogonal to both the elevating direction of the leaving cap 50 and the axial direction of the rotating shaft 67. Accordingly, in the state where the cam roller 62 axially supported on the tip end portion of the cam frame 61 of the cam mechanism 60 makes the circumferential surface thereof in contact with the flat surface part 57*a* as the part of the bottom surface of the recess 57 in the cap holder 55, the cam roller 62 supports the cap holder 55 from the lower side. In this state, the cam roller 62 can pass through the non-overlapping region. In other words, the cap holder 55 (leaving cap 50) can be detached from the maintenance unit 100 in this state.

Next, an action in the embodiment, that is, the drawing operation of the leaving cap 50 out of the maintenance unit 100 will be described with reference to FIGS. 8A to 8E. For example, when a user inputs a command to exchange the leaving cap 50 through the input panel 18, this operation is executed. In FIGS. 8A to 8E, the leaving cap 50, the cam mechanism 60, and the unit frame body 70 are illustrated schematically for making the explanation easy to understand.

Figures 8A, 8B, 8C, 8D, 8E:
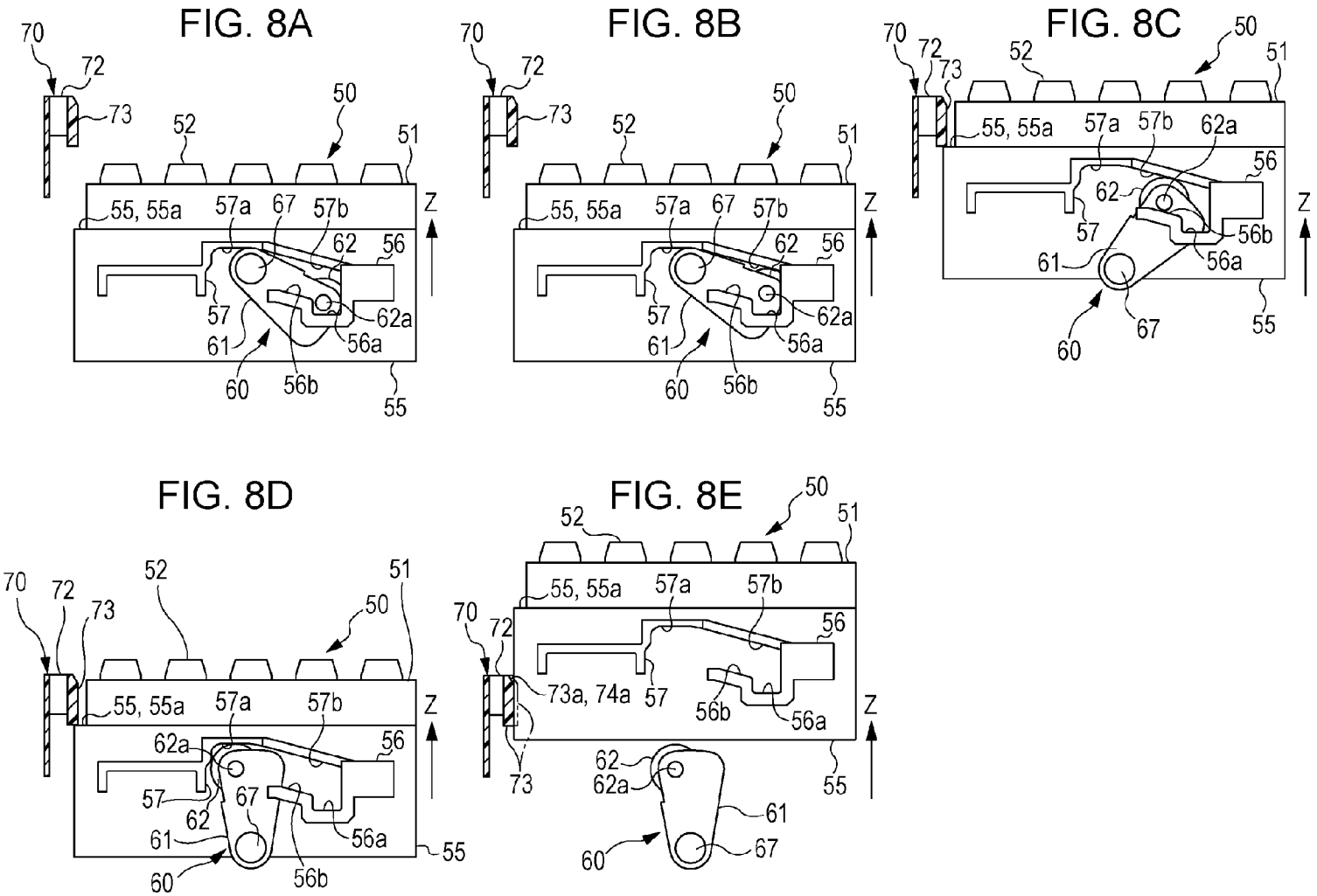
FIGS. 8A to 8E are operation views illustrating the leaving cap that is moved up and down by the cam mechanism.

First, as illustrated in FIG. 8A, in the state where the leaving cap 50 is attached to the maintenance unit 100, that is, in the state where the cap holder 55 is attached to the cam mechanism 60, the shaft portion 62*a* of the cam roller 62 is arranged in the recessed surface portions 56*a* of the wall portions 56. The cap holder 55 is coupled to the cam mechanism 60 in a state where rattling of the cap holder 55 in the up-down direction and the right-left direction is suppressed. To be more specific, the cap holder 55 is coupled to the cam mechanism 60 in a state where the flat surface part 57*a* of the recess 57 is supported by the base end portion of the cam frame 61 from the lower side while the recessed surface portions 56*a* of the wall portions 56 are locked by the shaft portion 62*a* of the cam roller 62 from the upper side. In this state, the projection ribs 73 of the unit frame body 70 are located at positions separated to the upper side from the front upper surface portion 55*a* of the cap holder 55.

Next, as illustrated in FIG. 8B, when the drawing operation is started, the rotating shaft 67 starts rotating in the counterclockwise direction from the state as illustrated in FIG. 8A and the shaft portion 62*a* of the cam roller 62 revolves about the rotating shaft 67 so as to be separated upward from the inner side surfaces of the recessed surface portions 56*a* of the wall portions 56 in the cap holder 55. Then, the cap holder 55 having the flat surface part 57*a* of the recess 57, which is supported by the circumferential surface of the base end portion of the cam frame 61, is made in a state where the flat surface part 57*a* of the recess 57 is supported from the lower side by the base end portion of the cam frame 61 while the cam roller 62 makes contact with the inclined surface part 57*b* of the recess 57 from the lower side. That is to say, the bottom surface of the recess 57 of the cap holder 55 is supported at two positions, that is, by the cam roller 62 and the cam frame 61 from the lower side. At this time, the projection ribs 73 of the unit frame body 70 are still separated from the cap holder 55.

Thereafter, as illustrated in FIG. 8C, when the rotating shaft 67 further rotates in the counterclockwise direction from the state as illustrated in FIG. 8B, the cam roller 62 moves along the inclined surface part 57*b* of the recess 57 in a rolling manner. Then, the cap holder 55 slides by being guided by the guide pins 45, and a portion of the cam roller 62 which supports the inclined surface part 57*b* of the recess 57 rises higher in the approaching direction (Z direction) of the approaching/separating direction. In this state, the shaft portion 62*a* of the cam roller 62 is located at a position opposing the inclined surface portions 56*b* of the wall portions 56 of the cap holder 55 in the up-down direction. Accordingly, even when the cap holder 55 is lifted in this state, the detachment of the cap holder 55 from the cam mechanism 60 is restricted because the shaft portion 62*a* of the cam roller 62 locks the inclined surface portions 56*b* of the wall portions 56 from the upper direction. The projection ribs 73 of the unit frame body 70 are made in a state of abutting against the lifted cap holder 55 as illustrated in FIG. 8C or a state of being closer to the lifted cap holder 55 with a slight space therebetween in this state.

Subsequently, as illustrated in FIG. 8D, when the rotating shaft 67 further rotates in the counterclockwise direction from the state as illustrated in FIG. 8C, the cam roller 62 moves along the recess 57 in the rolling manner so as to move to the flat surface part 57*a* from the inclined surface part 57*b*. With the movement, the circumferential surface of the cam roller 62 makes contact with the flat surface part 57*a* of the recess 57 of the cap holder 55 to support the cap holder 55 from the lower side. That is to say, the shaft portion 62*a* of the cam roller 62 is located in the non-overlapping region in the recess 57 of the cap holder 55, which does not overlap with the wall portions 56 in the right-left direction. Accordingly, the cam mechanism 60 is in a state capable of moving out of the inner side of the recess 57 through a lower space area of the flat surface part 57*a*. Also in this state, the projection ribs 73 of the unit frame body 70 are in the state of abutting against the cap holder 55 or the state of being closer to the cap holder 55 with the slight space therebetween. That is to say, the projection ribs 73 in the state of being engaged with the cap holder 55 in the approaching/separating direction are located at the restricting position to restrict the drawing of the cap holder 55 out of the guide pins 45.

Then, as illustrated in FIG. 8E, the user displaces the extending portion 72 of the unit frame body 70 by pulling the step part 74 to the front side so as to move the projection ribs 73 to positions at which they are not engaged with the cap holder 55 in the approaching/separating direction (Z direction) of the leaving cap 50. That is to say, the user moves the projection ribs 73 to the allowing position at which the ribs are not engaged with the cap holder in the approaching/separating direction and allow the cap holder 55 to be drawn out of the guide pins 45. This movement operation by the user enables the cap holder 55 to be drawn out of the cam mechanism 60, that is, drawn out of the maintenance unit 100 and exchanged.

Meanwhile, in the state as illustrated in FIG. 8D, when the user tries to detach the leaving cap 50 from the maintenance unit 100, a drawing force acts on the projection ribs 73 of the extending portion 72 from the lower side. Therefore, in the embodiment, the shape of the extending portion 72 is set such that the extending portion 72 has strength so as not to be plastic-deformed against the drawing force to an extent that the user can determine to be incapable of drawing the leaving cap 50 with the currently applying drawing force. In addition, the plate thickness, the plate width, and the like of the extending portion 72 are set such that the extending portion 72 can be elastically deformed and moved to the front side to the position at which the projection ribs 73 are not engaged with the cap holder 55 in the approaching/separating direction (Z direction) of the leaving cap 50 by pulling the step part 74 to the front side.

Although detail description is omitted here, the operation of attaching the replacement leaving cap 50 to the maintenance unit 100 is an operation performed in the reversed order of the detachment operation. That is to say, the operation is performed in the order from the state as illustrated in FIG. 8E to the state as illustrated in FIG. 8A. In the operation of attaching the leaving cap 50, position adjustment between the guide holes 55H of the cap holder 55 and the guide pins 45 to be inserted into the guide holes 55H is performed by visually checking the guide pins 45 through the guide holes 55H as the through-holes. Further, when the guide pins 45 are inserted into the guide holes 55H, as illustrated in FIG. 8E, the cap holder 55 abuts against the inclined surfaces 73*a* of the projection ribs 73 (and the inclined surface 74*a* of the step part 74) from the upper side so as to displace the projection ribs 73 to the front side (Y direction) with the downward movement of the cap holder 55. With the displacement, the projection ribs 73 are moved to the allowing position at which the ribs are not engaged with the cap holder 55 in the approaching/separating direction of the leaving cap 50. Further, as illustrated in FIG. 8B or FIG. 8C, in the state where the guide pins 45 have been inserted into the guide holes 55H of the cap holder 55, the abutment of the projection ribs 73 against the cap holder 55 is cancelled, so that the projection ribs 73 are returned to the restricting position at which they are engaged with the cap holder 55 in the approaching/separating direction of the leaving cap 50, with the elastic force of the extending portion 72.

With the above-mentioned embodiment, the following effects can be obtained.

1. The projection ribs 73 as the engagement portion are displaced with the step part 74 as the displacement operating portion, so that the cap holder 55 can be drawn out of the maintenance unit 100. Accordingly, the cap holder 55 (cap member 51) can be exchanged easily without detaching any members from the maintenance unit 100, for example.

2. The step part 74 as the displacement operating portion is located at the position separated from the suction cap 41 and the wiper 42 as the head maintenance portions. Therefore, a possibility that the liquid discharged from the liquid ejecting head 28 attaches to the step part 74 is lowered. This suppresses a problem that a user's hand becomes dirty when the user operates the step part 74.

3. The guide pins 45 can be inserted into the guide holes 55H of the cap holder 55 easily while checking the positions of the guide pins 45 through the guide holes 55H as the through-holes. Accordingly, the leaving cap 50 (the cap holder 55, the cap member 51, and the like) can be exchanged easily.

4. In the case where the cap holder 55 is intended to be drawn out of the guide pins 45 in a state where the projection ribs 73 as the engagement portion are located at the restricting position, since the pair of guide pins 45 and the projection ribs 73 are aligned substantially in line, a force of inclining the cap holder 55 with respect to the guide pins 45 is difficult to be applied. This suppresses deformation of the cap holder 55, for example.

5. The printer 11 that enables the leaving cap 50 (the cap holder 55, the cap member 51, and the like) to be exchanged easily can be provided.

6. The step part 74 as the displacement operating portion can be operated from the discharge direction side to which the ejection target member 20 onto which the liquid ejecting head 28 has ejected ink is discharged. Accordingly, the step part 74 is operated from the front side of the printer 11 as the discharge direction of the ejection target member 20 normally, so that the exchange operation in which the cap holder 55 (cap member 51) is exchanged can be performed easily.

It should be noted that the above-mentioned embodiment may be modified as follows.

In the above-mentioned embodiment, the member that can be displaced between the restricting position and the allowing position for drawing the leaving cap 50 is not necessarily limited to the unit frame body 70 arranged at the front (Y direction) end portion in the maintenance unit 100.

Figure 9:
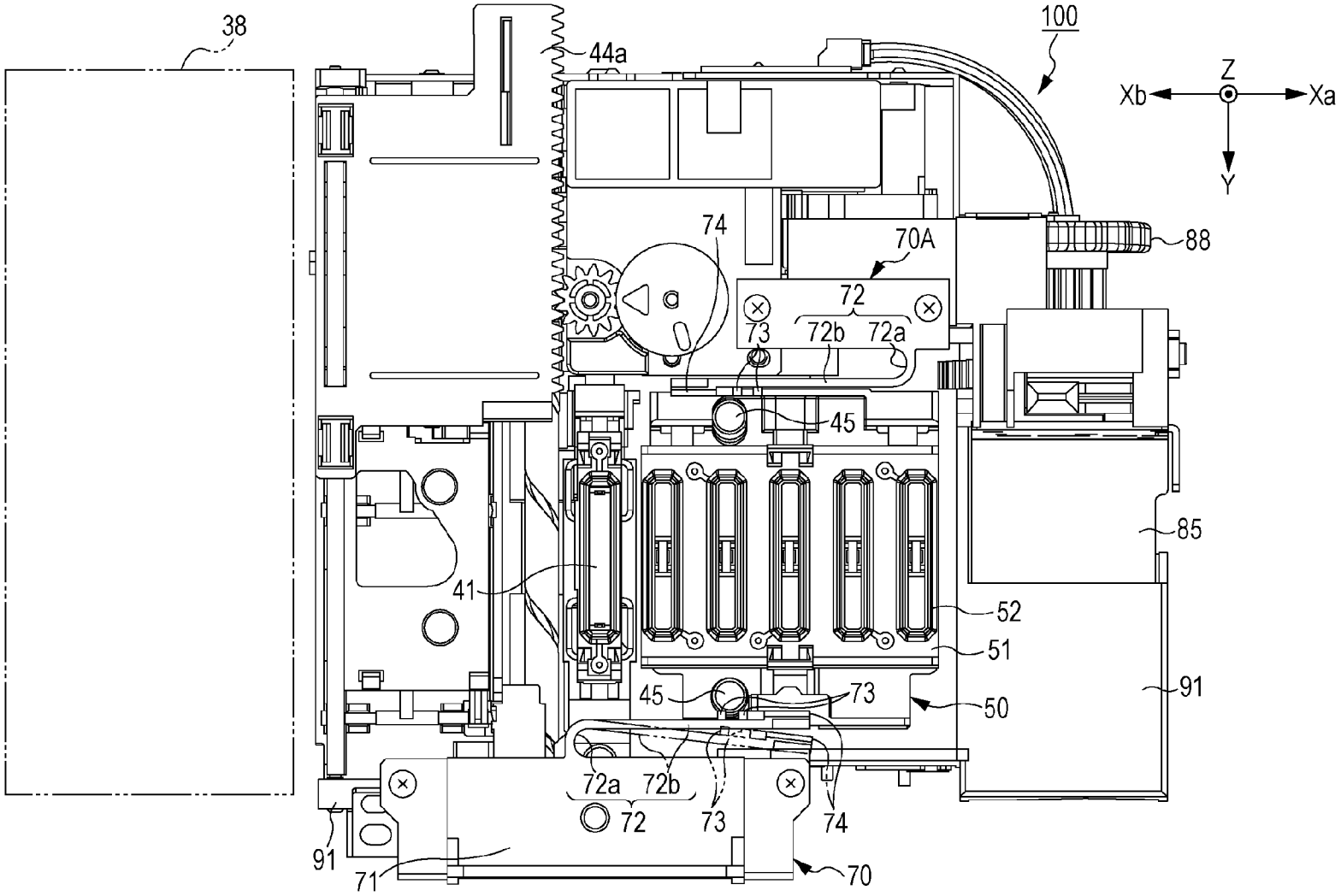
FIG. 9 is a plan view illustrating a variation on an engagement portion that is engaged with a leaving cap.

For example, as illustrated in FIG. 9, in the maintenance unit 100, another unit frame body 70A on which the extending portion 72 same as that in the above-mentioned embodiment is provided may be fixed on the rear side of the leaving cap 50 in addition to the unit frame body 70 in the above-mentioned embodiment. In this case, the projection ribs 73 provided on the extending portion 72 of another unit frame body 70A are preferably arranged at positions at which at least one of the projection ribs 73 overlaps with the pair of guide pins 45 in the alignment direction of the guide pins 45. FIG. 9 (and FIG. 10) illustrate(s) a state where the wiper 42 is not provided in the maintenance unit 100, that is, a state where the ink absorber 43 is not provided on the unit frame body 70.

The step part 74 as the displacement operating portion in another unit frame body 70A is located at a position closer to the suction cap 41 relative to the projection ribs 73. Accordingly, in such a case, although not illustrated in the drawings, the position of the displacement operating portion (step part 74) is preferably changed such that it is formed at a position farther from the suction cap 41 on the extending portion 72 of another unit frame body 70A in the following manner. That is, the displacement operating portion (step part 74) is provided at a position between the bent plate section 72*a* and the projection ribs 73 on the extending portion 72. Further, only the extending portion 72 (projection ribs 73) of another unit frame body 70A in FIG. 9 may be provided in the maintenance unit 100 while the unit frame body 70 is detached. Alternatively, although not illustrated in the drawings, there arises no problem even if the unit frame body 70 (unit frame body 70A) may be fixed on the right side (Xa direction side) of the leaving cap 50 in the maintenance unit 100.

Figure 10:
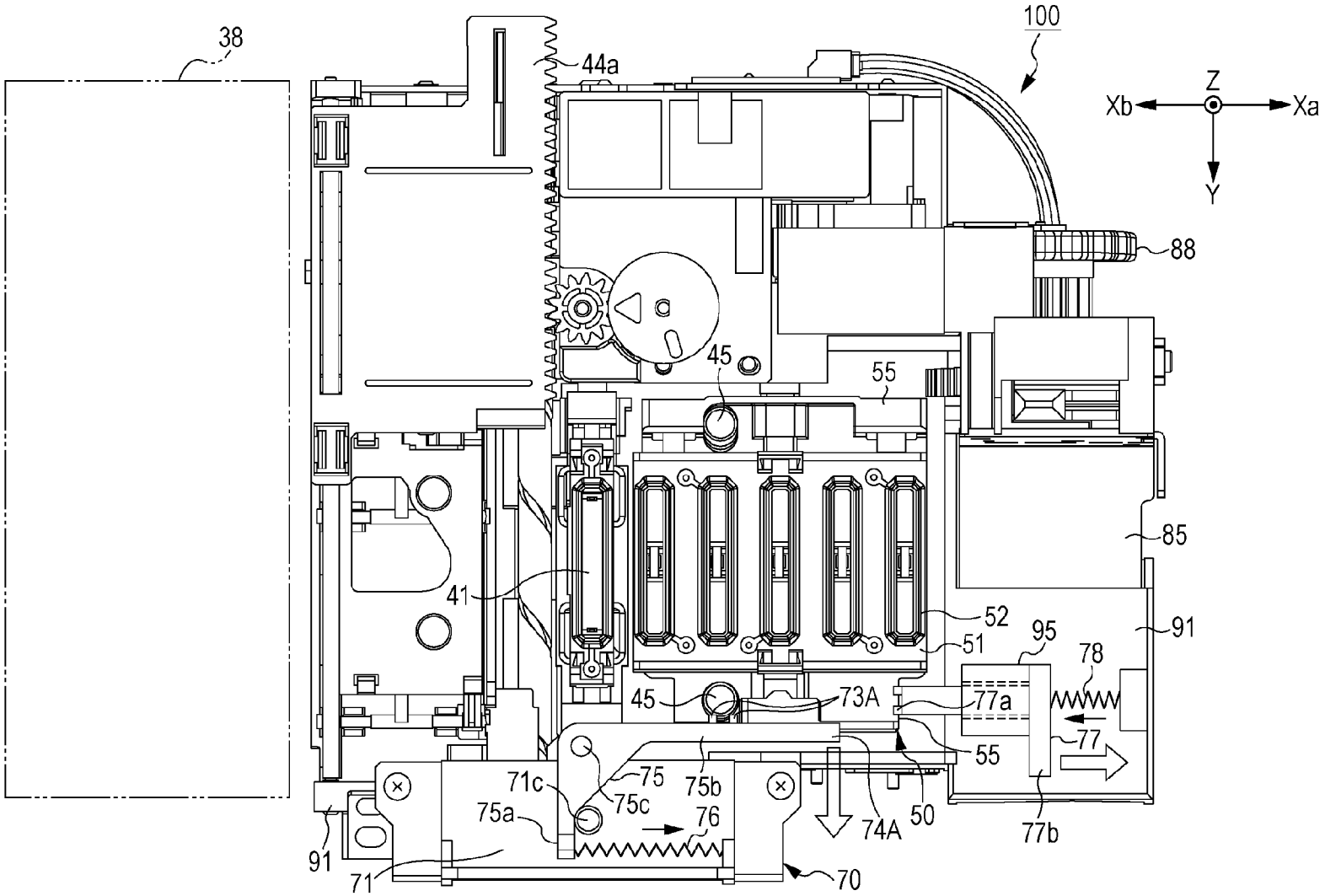
FIG. 10 is a plan view illustrating another configuration of an engagement portion which is engaged with the leaving cap.

As illustrated in FIG. 10, the engagement portion and the displacement operating portion may be provided with the configuration different from that of the unit frame body 70 in the above-mentioned embodiment. For example, in the unit frame body 70, a rotating member 75 is axially supported on the frame body portion 71 in a rotatable manner about a rotating shaft 75*c* instead of the extending portion 72. The rotating member 75 has a substantially L shape when seen from the above. One end side 75*a* of the L shape of the rotating member 75 is biased by a tension spring 76 so as to be made in a state of abutting against a contact pin 71*c* provided on the frame body portion 71, and the engagement portion and the displacement operating portion are provided on the other end side 75*b* of the L shape. That is to say, a protrusion part 73A protruding to the rear side is formed as the engagement portion on halfway of the other end side and a tip end portion 74A of the other end side 75*b* is formed as the displacement operating portion. Accordingly, the user moves the tip end portion 74A to the front side (Y direction) as indicated by an outlined arrow in FIG. 10 so as to rotate the rotating member 75 and displace the protrusion part 73A to the allowing position from the restricting position.

Alternatively, as illustrated in FIG. 10, a movable body 77 is provided. The movable body 77 is attached to a base 95 fixed to the frame member 91 of the maintenance unit 100 in a state capable of reciprocating along the X direction. Further, the movable body 77 is biased to the left side (Xb direction) by a compression spring 78 all the time. A left end portion 77*a* of the movable body 77 is formed as the engagement portion and a projecting portion 77*b* formed so as to project to the front side at a right end portion of the movable body 77 is formed as the displacement operating portion. Accordingly, the user moves the projecting portion 77*b* to the right side (Xa direction) as indicated by an outlined arrow in FIG. 10 so as to move the movable body 77 and displace the left end portion 77*a* to the allowing position from the restricting position.

In addition, a variation on the drawing restricting member of the leaving cap 50 including the engagement portion and the displacement operating portion, which has a configuration different from that of the extending portion 72 of the unit frame body 70 in the above-mentioned embodiment, will be described with reference to FIGS. 11A to 11C. It should be noted that FIG. 11A corresponds to FIG. 8A, FIG. 11B corresponds to FIG. 8D, and FIG. 11C corresponds to FIG. 8E. Description of the movement operation of the leaving cap 50 in the approaching/separating direction is omitted here.

Figure 11C:
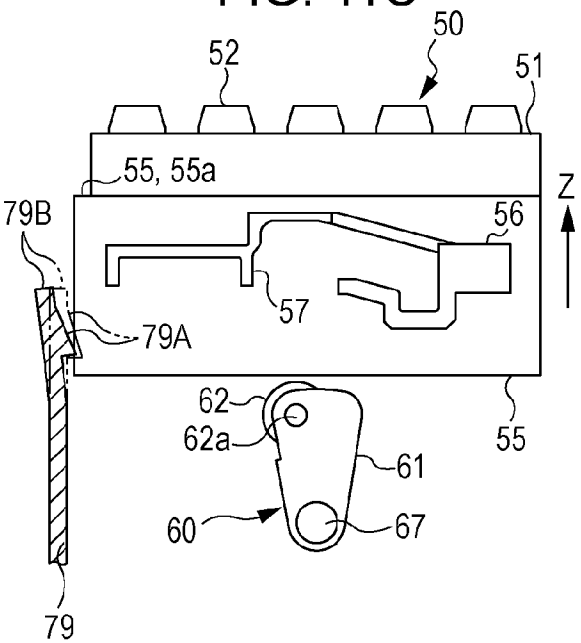
FIGS. 11A to 11C are plan views schematically illustrating an engagement portion having another configuration which is engaged with the leaving cap, and operation thereof.
Figure 11B:
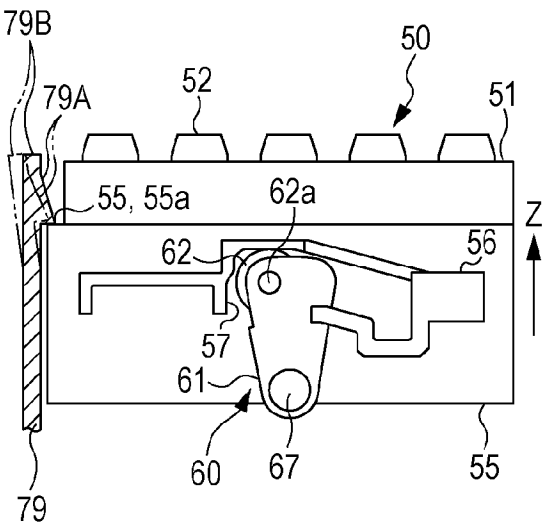
Figure 11A:
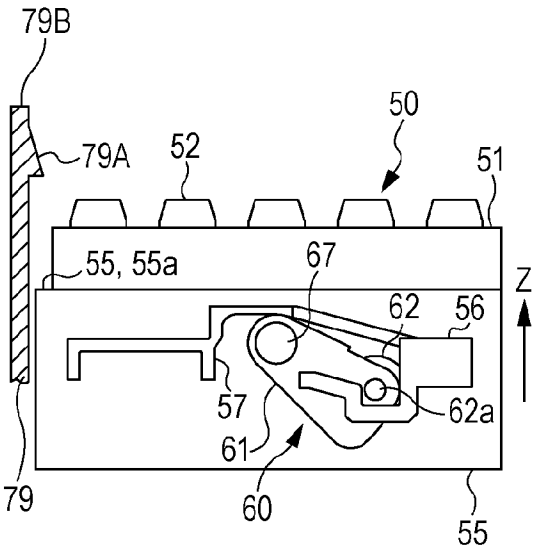

As illustrated in FIG. 11A, a hook-shaped portion 79 including a projecting portion 79A is provided. The hook-shaped portion 79 is erected so as to extend upward (Z direction) from a base end side thereof fixed to the unit frame body 70 or the frame structure 90 in the vertical direction. The projecting portion 79A is provided at a tip end side of the hook-shaped portion 79 toward the leaving cap 50. The projecting portion 79A has a cross section of a triangular shape with its lower side being the base. Further, an extension part 79B having a predetermined length is provided on the hook-shaped portion 79 at a higher tip end side than the projecting portion 79A.

As illustrated in FIG. 11B, the projecting portion 79A of the hook-shaped portion 79 is engaged with the cap holder 55 in a state where the leaving cap 50 can be drawn in the approaching/separating direction. That is to say, the projecting portion 79A of the hook-shaped portion 79 functions as the engagement portion. In this state, the user moves the extension part 79B of the hook-shaped portion 79 away from the leaving cap 50 so as to displace the projecting portion 79A as indicated by a two-dot chain line in FIG. 11B. That is to say, the extension part 79B of the hook-shaped portion 79 functions as the displacement operating portion.

As illustrated in FIG. 11C, the user displaces the projecting portion 79A so as to move the projecting portion 79A to the allowing position at which it is not engaged with the cap holder 55 in the approaching/separating direction of the leaving cap 50, and then, draws the leaving cap 50 out of the maintenance unit 100 to exchange it. When the replacement leaving cap 50 is attached to the maintenance unit 100 again, the projecting portion 79A of the hook-shaped portion 79 is bent and displaced from a state as indicated by the a two-dot chain line in FIG. 11C to a state as indicated by a solid line so as to allow the leaving cap 50 to be attached. In this respect, the hook-shaped portion 79 functions as what is called a snap-fit.

In the above-mentioned embodiment, the engagement portion (two projection ribs 73) and the displacement operating portion (step part 74) may not be necessarily provided integrally and may be configured as separate members. That is to say, the drawing restricting member may not be formed by an integrated member. Although not illustrated in the drawings, for example, a configuration in which the separate members are configured to operate together with a linking mechanism, a cam mechanism, or the like so that the engagement portion is displaced in response to the movement of the displacement operating portion may be employed.

In the above-mentioned embodiment, the displacement operating portion (step part 74) may not be necessarily located at the downstream side in the discharge direction of the ejection target member 20 to be discharged in the maintenance unit 100. For example, like the extending portion 72 of another unit frame body 70A as illustrated in FIG. 9, the displacement operating portion may be located at the upstream side in the discharge direction of the ejection target member 20 in the maintenance unit 100.

In the above-mentioned embodiment, the engagement portion may not be necessarily provided at a position overlapping with the pair of guide pins 45 that are inserted into the cap holder 55 in the alignment direction of the guide pins 45. For example, like the left end portion 77*a* of the movable body 77 as illustrated in FIG. 10, the engagement portion may be located at a position at which it is not aligned with the pair of guide pins 45, at the right side away from the suction cap 41 in the maintenance unit 100.

In the above-mentioned embodiment, not both the two guide holes 55H provided in the cap holder 55 may be through-holes. For example, one of them (for example, front one) may be a through-hole. Alternatively, when the guide holes 55H have such shapes that the guide pins 45 are inserted thereinto easily, there arises no problem even if none of them is a through-hole.

In the above-mentioned embodiment, the displacement operating portion may not be necessarily provided at the position separated from the head maintenance portion relative to the engagement portion. For example, when the suction cap is farther from the leaving cap, or when the possibility that ink attaches to the displacement operating portion is low, the displacement operating portion may be provided at a position closer to the head maintenance portion relative to the engagement portion as another unit frame body 70A as illustrated in FIG. 9.

In the above-mentioned embodiment, the leaving cap 50 may not be necessarily elevated in the approaching/separating direction. Further, a configuration in which the cap holder 55 can be drawn to the upper side all the time regardless of the rotational movement position of the cam roller 62 in the cam mechanism 60 may be employed.

In the above-mentioned embodiment, the engagement portion is engaged with the leaving cap 50. However, the engagement portion is not necessarily limited to be engaged with the leaving cap 50. For example, the engagement portion may be engaged with the suction cap 41.

In the above-mentioned embodiment, the drawing operation of the leaving cap 50 out of the maintenance unit 100 may be executed at the same time as the exchange time of the maintenance members in the maintenance unit 100, that is, the suction cap 41, the wiper 42, the absorbing member 38, and the flushing box 34. In this case, even if the user does not input the command to exchange the leaving cap 50, the cam mechanism 60 may stand by in the state capable of being moved away from the inner side of the recess 57 as illustrated in FIG. 8D when the maintenance members are exchanged.

In the above-mentioned embodiment, the medium supporting tray 14 may be arranged in a fixed manner as long as the medium supporting tray 14 and the liquid ejecting head 28 can be moved relatively in the X direction and the Y direction. For example, the first housing portion 12 may be moved in the front-rear direction along the Y direction.

In the above-mentioned embodiment, a supply source of liquid that is ejected from the liquid ejecting head 28 may be the ink cartridges 31 or an ink accommodation member provided at the outer side of the first housing portion 12. When ink is supplied to the liquid ejecting head 28 from the ink accommodation member, an ink supply tube for supplying the ink is required to be routed in the first housing portion 12. Accordingly, it is preferable that a hole or a cutout be provided in the first housing portion 12 and the ink supply tube be inserted through the hole or the cutout. Alternatively, a configuration in which bosses or the like are erected so that open/close members such as the open/close cover 17 and the upper cover 19 provided on the first housing portion 12 in an openable/closable manner are not closed completely with respect to the first housing portion 12 and the ink supply tube is routed in the first housing portion 12 using spaces formed by the bosses may be employed.

In the above-mentioned embodiment, as the ejection target member 20, any materials including paper, films, metal films, plate materials, seals, fabrics, clothes such as T-shirts, Japanese clothes such as kimonos, and three-dimensional materials can be selected arbitrarily as long as they can be set onto the medium supporting tray 14.

In the above-mentioned embodiment, the printer 11 may be a liquid ejecting apparatus that ejects and discharges liquid other than ink. The state of liquid which is discharged from the liquid ejecting apparatus as a trace amount of liquid droplets includes a granule form, a teardrop form, and a form that pulls tails in a string-like form therebehind. The term "liquid" here represents materials which can be ejected by the liquid ejecting apparatus. For example, any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) can be included as the liquid. Further, the liquid is not limited to liquid as one state of a material and includes a solution in which particles of a functional material made of a solid material such as pigment or metal particles are dissolved, dispersed, or mixed in a solvent. Typical examples of the liquid are ink described in the above embodiment and liquid crystals. The term "ink" here encompasses various liquid compositions such as common aqueous ink and oil ink, gel ink and hot melt ink. Specific examples of the liquid ejecting apparatus include a liquid ejecting apparatus which ejects liquid in a form of dispersion or dissolution of a material such as an electrode material or a coloring material. The material such as the electrode material or the coloring material is used for manufacturing a liquid crystal display, an electroluminescence (EL) display, a surface emitting display or a color filter, for example. Further, the specific examples of the liquid ejecting apparatus may include a liquid ejecting apparatus which ejects a bioorganic material to be used for manufacturing a biochip, a liquid ejecting apparatus which is used as a precision pipette and ejects liquid serving as a sample, a printing device, a micro dispenser, and so on. Other examples of the liquid ejecting apparatus may include a liquid ejecting apparatus which pinpoint-ejects lubricating oil into a precision machine, such as a watch or a camera. Further, a liquid ejecting apparatus which ejects a transparent resin solution of an ultraviolet curing resin or the like onto a substrate in order to form a hemispherical microlens (optical lens) to be used in an optical communication element and the like may be included as the liquid ejecting apparatus. In addition, a liquid ejecting apparatus which ejects an acid or alkali etching solution for etching a substrate or the like may be employed as the liquid ejecting apparatus.

The entire disclosure of Japanese Patent Application No. 2013-118571, filed Jun. 5, 2013 is expressly incorporated by reference herein.

What is claimed is:

1. A maintenance unit which maintains a liquid ejecting head in which nozzles for ejecting liquid onto an ejection target member are formed, the maintenance unit comprising:

a cap holder that has a cap member capable of abutting against the liquid ejecting head so as to surround the nozzles;

a pair of guide pins that are inserted into the cap holder and guide the cap holder in a movable manner in an approaching/separating direction in which the cap member approaches and is separated from the liquid ejecting head;

an engagement portion that is capable of being engaged with the cap holder in the approaching/separating direction; and a displacement operating portion that displaces the engagement portion between a restricting position at which the engagement portion restricts drawing of the cap holder out of the guide pins and an allowing position at which the engagement portion is not engaged with the cap holder in the approaching/separating direction and allows the cap holder to be drawn out of the guide pins, wherein the engagement portion is provided at a position at which at least a part of the engagement portion overlaps with the pair of guide pins to be inserted into the cap holder in a direction in which the guide pins are aligned.

2. The maintenance unit according to claim 1, further comprising a head maintenance portion that maintains the liquid ejecting head by discharging the liquid from the nozzles, wherein the displacement operating portion is provided at a position separated from the head maintenance portion relative to the engagement portion.

3. A liquid ejecting apparatus comprising:

a liquid ejecting head that ejects liquid onto an ejection target member; and the maintenance unit according to claim 2.

4. The maintenance unit according to claim 1, wherein the cap holder is provided with guide holes into which the guide pins are inserted, and the guide holes are through-holes penetrating the cap holder.

5. A liquid ejecting apparatus comprising:

a liquid ejecting head that ejects liquid onto an ejection target member; and the maintenance unit according to claim 4.

6. A liquid ejecting apparatus comprising:

a liquid ejecting head that ejects liquid onto an ejection target member; and the maintenance unit according to claim 1.

7. The liquid ejecting apparatus according to claim 6, further comprising:

a discharge portion that discharges the ejection target member onto which the liquid has been ejected, wherein the displacement operating portion is located at a downstream side in a discharge direction in which the ejection target member is discharged in the maintenance unit.

8. A liquid ejecting apparatus comprising:

a liquid ejecting head that ejects liquid onto an ejection target member; and a maintenance unit that maintains a liquid ejecting head in which nozzles for ejecting liquid onto an ejection target member are formed, the maintenance unit comprising:

a cap holder that has a cap member capable of abutting against the liquid ejecting head so as to surround the nozzles;

a guide pin that is inserted into the cap holder and guide the cap holder in a movable manner in an approaching/separating direction in which the cap member approaches and is separated from the liquid ejecting head;

an engagement portion that is capable of being engaged with the cap holder in the approaching/separating direction; and a displacement operating portion that displaces the engagement portion between a restricting position at which the engagement portion restricts drawing of the cap holder out of the guide pins and an allowing position at which the engagement portion is not engaged with the cap holder in the approaching/separating direction and allows the cap holder to be drawn out of the guide pins, wherein the displacement operating portion is located at a downstream side in a discharge direction in which the ejection target member is discharged relatively in the maintenance unit.

9. A liquid ejecting apparatus comprising:

a liquid ejecting head that ejects liquid onto an ejection target member; and a maintenance unit that maintains a liquid ejecting head in which nozzles for ejecting liquid onto an ejection target member are formed, the maintenance unit comprising:

a cap holder that has a cap member capable of abutting against the liquid ejecting head so as to surround the nozzles;

a guide pin that is inserted into the cap holder and guide the cap holder in a movable manner in an approaching/separating direction in which the cap member approaches and is separated from the liquid ejecting head;

an engagement portion that is capable of being engaged with the cap holder in the approaching/separating direction; and a displacement operating portion that displaces the engagement portion between a restricting position at which the engagement portion restricts drawing of the cap holder out of the guide pins and an allowing position at which the engagement portion is not engaged with the cap holder in the approaching/separating direction and allows the cap holder to be drawn out of the guide pins, wherein the displacement operating portion is located at an upstream side in a discharge direction in which the ejection target member is discharged relatively in the maintenance unit.

10. A maintenance unit which maintains a liquid ejecting head in which nozzles for ejecting liquid onto an ejection target member are formed, the maintenance unit comprising:

a cap holder that has a cap member capable of abutting against the liquid ejecting head so as to surround the nozzles;

a pair of guide pins that are inserted into the cap holder and guide the cap holder in a movable manner in an approaching/separating direction in which the cap member approaches and is separated from the liquid ejecting head, the guide pins being disposed in the approaching/separating direction;

an engagement portion that is capable of being engaged with the cap holder in the approaching/separating direction; and a displacement operating portion that displaces the engagement portion between a restricting position at which the engagement portion restricts drawing of the cap holder out of the guide pins and an allowing position at which the engagement portion is not engaged with the cap holder in the approaching/separating direction and allows the cap holder to be drawn out of the guide pins.

11. The maintenance unit according to claim 10, wherein the guide pins are arranged to extend in a direction along the approaching/separating direction.

12. A liquid ejecting apparatus comprising:

a liquid ejecting head that ejects liquid onto an ejection target member; and the maintenance unit according to claim 11.

13. A liquid ejecting apparatus comprising:

a liquid ejecting head that ejects liquid onto an ejection target member; and the maintenance unit according to claim 10.

* * * * *